United States Patent [19]

Rossmann

[11] Patent Number: 4,846,072

[45] Date of Patent: Jul. 11, 1989

[54] CONNECTION ARRANGEMENT BETWEEN A SABOT JACKET AND THE REAR PORTION OF A SABOT PROJECTILE

[75] Inventor: Rudolf Rossmann, Bülach, Switzerland

[73] Assignee: Werkzeugmaschinenfabrik Oerlikon-Bührle AG, Zurich, Switzerland

[21] Appl. No.: 217,675

[22] Filed: Jul. 11, 1988

Related U.S. Application Data

[63] Continuation-in-part of Ser. No. 400,618, Aug. 22, 1982, Pat. No. 4,773,331.

[51] Int. Cl.[4] ..... F42B 13/16

[52] U.S. Cl. ..... 102/520; 102/523

[58] Field of Search ..... 102/520–523

[56] References Cited

U.S. PATENT DOCUMENTS 3,927,618 12/1975 Engel ..... 102/522

4,773,331 9/1988 Rossman ..... 102/520

*Primary Examiner*—Harold J. Tudor

*Attorney, Agent, or Firm*—Werner W. Kleeman

[57] ABSTRACT

Increasingly greater requirements as concerns mechanical strength and gas tightness are placed upon the connection between the sabot tail or rear portion and the sabot jacket of a sabot projectile. To improve such connection the invention contemplates subdividing the prior conventional circumferential groove at the sabot tail or rear portion into a rear sealing groove and a front holding groove. In corresponding fashion the sabot jacket possesses a rear sealing lip or flange which protrudes into the rear sealing groove of the sabot tail or rear portion and a holder rib which protrudes into the front holding groove of the sabot tail or rear portion. According to a particular construction the rear sealing groove possesses mutually parallel side walls which are forwardly inclined with respect to the lengthwise axis of the projectile at an angle of about 75°.

12 Claims, 3 Drawing Sheets

CONNECTION ARRANGEMENT BETWEEN A SABOT JACKET AND THE REAR PORTION OF A SABOT PROJECTILE

CROSS-REFERENCE TO RELATED APPLICATION

This application is a continuation-in-part of my commonly assigned, copending U.S. application Ser. No. 06/400,618, filed July 22, 1982, entitled: "CONNECTION ARRANGEMENT BETWEEN A SABOT JACKET AND THE REAR PORTION OF A SABOT PROJECTILE" now U.S. Pat. No. 4,773,331, granted Sept. 27, 1988.

This continuation-in-part application is also related to the commonly assigned, copending U.S. application Ser. No. 07/180,094, filed Apr. 11, 1988, and entitled: "SABOT PROJECTILE CONTAINING A SABOT REAR PORTION HAVING REFERENCE FRACTURE LOCATIONS".

BACKGROUND OF THE INVENTION

The present invention relates to a new and improved connection arrangement or connection between the sabot jacket and the sabot tail or rear portion of a sabot projectile.

Generally speaking, there is provided a circumferential groove at the sabot tail portion into which protrudes a lip or flange of the sabot jacket, in order to form a connection between the sabot jacket and the sabot tail portion which, on the one hand, withstands the mechanical forces upon firing of the sabot projectile and, on the other hand, is gastight.

According to state-of-the-art constructions of sabot projectiles as disclosed, for instance, in U.S. Pat. No. 4,249,466, granted Feb. 10, 1981 and the cognate Swiss Pat. No. 622,833, granted Apr. 30, 1981, as well as U.S. Pat. No. 3,927,618, granted Dec., 23, 1975, the connection between the sabot jacket and the sabot tail or rear portion comprises a single groove provided at the sabot tail or rear portion and into which protrudes a single rib or rib member of the sabot jacket. This single groove and this single rib should be capable of withstanding both the mechanical forces and also the high gas pressure. However, there exits an appreciable danger that the sabot jacket, during firing of the projectile, will prematurely detach from the sabot tail or rear portion, especially during transfer of the sabot projectile from the cartridge chamber of the firing weapon into the weapon barrel, or that the connection is not gastight so that a portion of the gas pressure is lost. When the firing weapon fires at a greater firing cadence appreciable acceleration and deceleration forces arise during the infeed of the cartridges to the firing weapon. Consequently, the danger exists that the connection between the sabot tail portion and the sabot jacket already will become damaged prior to infeed of the projectile into the firing weapon. Furthermore, the cartridge casing is secured in a circumferential groove of the sabot tail or rear portion. The deeper that this circumferential groove is that much greater are the forces required for the ejection of the projectile out of the cartridge casing, and thus, the greater the gas pressure at the instant when the projectile exits from the cartridge casing. Therefore, increased requirements are placed upon the gastight connection and the mechanical strength between the sabot jacket and the sabot tail or rear portion.

In particular, this connection is endangered as long as the projectile, following the ignition of the propellant charge in the cartridge casing, moves in a free flight path and does not yet contact the rifling grooves of the weapon barrel. Hence, this connection arrangement or connection is not yet held together or supported by the rifling grooves or ribs, that is to say, during such time as the rotating or guide band is not yet supported or guided at its outer surface by the rifling grooves in the weapon barrel. In the weapon barrel itself the rotating or guide band of the sabot jacket is pressed against the sabot tail or rear portion.

SUMMARY OF THE INVENTION

Therefore, with the foregoing in mind it is a primary object of the present invention to provide an improved connection arrangement between the sabot jacket and the sabot tail or rear portion of a sabot projectile.

Another and more specific object of the present invention aims at providing an improved connection or connection arrangement between the sabot jacket and the sabot tail or rear portion, in a manner such that such connection or connection arrangement is capable of withstanding large mechanical forces and large gas pressures upon firing of the sabot projectile.

Now in order to implement these and still further objects of the invention, which will become more readily apparent as the description proceeds, the connection arrangement between the sabot jacket and the sabot tail portion of a sabot projectile, as contemplated by the present invention, is manifested, among other things, by the features that there is provided a sealing groove at the sabot tail or rear portion into which there protrudes a sealing lip or flange of the sabot jacket. There is also provided a holding or holder groove at the sabot tail or rear portion into which protrudes a holder rib or flange of the sabot jacket. By virtue of such connection arrangement there is achieved a good connection between the sabot tail or rear portion and the sabot jacket which, on the one hand, withstands the mechanical forces and, on the other hand, the high gas pressures which arise upon firing of the sabot projectile.

Stated in another and more specific way, the connection or connection arrangement between the sabot tail or rear portion and the sabot jacket of the sabot projectile is manifested, among other things, by the following features:

The sabot tail or rear portion possesses a circumferential sealing groove and a circumferential holding or holder groove and the sabot jacket possesses a circumferential sealing rib or flange and a circumferential holder rib or flange which fit or extend into the aforementioned circumferential sealing groove and circumferential holding or holder groove, respectively.

Preferably, the side walls of the circumferential sealing groove are disposed substantially parallel to one another and inclined forwardly at an angle of about 75° with respect to the lengthwise axis of the projectile. The circumferential holder or holding groove is preferably bounded by side walls which are outwardly inclined with respect to one another, in other words, forwardly and rearwardly inclined in relation to the projectile lengthwise axis through an angle of about 75°.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it will be understood that in order to simplify the illustration thereof only enough of the construction of the sabot projectile has been depicted for the various exemplary embodiments, in order to enable those skilled in the art to readily understand the underlying principles and concepts of the present development.

Figure 1:
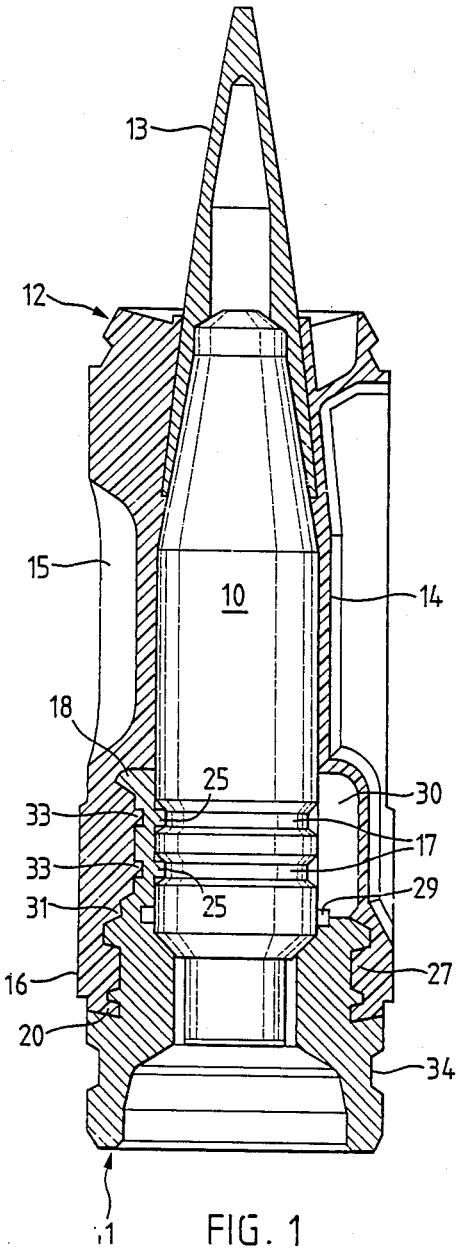
FIG. 1 is a longitudinal sectional view through a first exemplary embodiment of sabot projectile constructed according to the invention.
Figure 2:
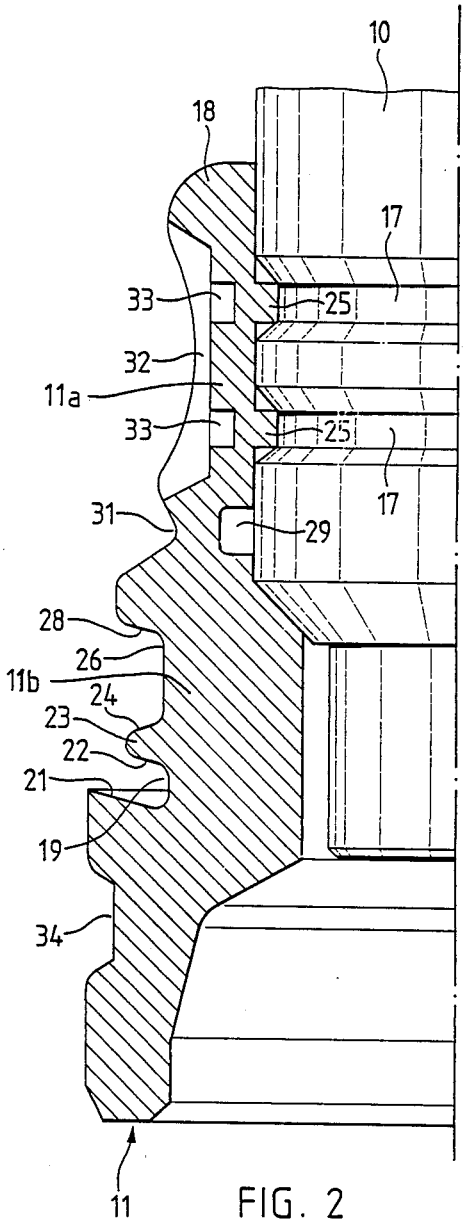
FIG. 2 is an enlarged detail showing of a part of the sabot tail or rear portion of the sabot projectile depicted in FIG. 1.

By referring now to FIGS. 1 and 2 there will be recognized that a first exemplary embodiment of sabot projectile constructed according to the present invention and as depicted therein, comprises a projectile body or projectile 10, a sabot tail or rear portion 11 and a sabot jacket 12. Mounted or secured upon the projectile body 10 is a ballistic hood 13. A hard metal alloy, preferably a tungsten alloy, can be beneficially used for the fabrication of the projectile body 10, as is well known in the ordnance arts. The sabot tail portion 11 is preferably manufactured, for instance, from a light metal and the sabot jacket 12 is fabricated, for instance, from a suitable plastics material. The sabot jacket 12 usually consists of three segments which are interconnected with one another by means of suitable reference fracture locations 14. In the drawing of FIG. 1 there is only visible one of these reference fracture locations 14. Additionally, the sabot jacket 12 possesses recesses 15 and a guide or rotating band 16. The projectile body 10 possesses two circumferential grooves 17 which serve for the attachment of the sabot tail or rear portion 11. This sabot tail portion 11 is provided with, for instance, six tongue members 18 which protrude by means of protuberances or dogs 25 or equivalent structure into the circumferential grooves 17 of the projectile body 10.

The heretofore described construction of the sabot projectile is known as such, but it is thought useful to nonetheless consider certain of the following likewise known features in order to gain a better appreciation of the teachings of the present invention which relate to the connection arrangement or connection between the sabot jacket 12 and the sabot tail or rear portion 11.

In order that the sabot tail or rear portion 11 can separate from the projectile body 10 upon departure of the sabot projectile from the weapon barrel of the firing weapon, there is provided an inner groove or groove member 29 at the region of the front ring or annular portion 11*a* of the sabot tail or rear portion 11, by means of which there is formed at least part of a reference fracture location or reference fracture means at which the tongues or tongue members 18 can be broken off from the sabot tail portion 11. As will be particularly apparent from the second embodiment of sabot projectile depicted in FIGS. 3 and 4, and particularly from the illustration of FIG. 4, the six tongues or tongue members 18 are separated from one another by six slots 30. By virtue of the groove or groove member 29 which has been depicted at the front ring portion 11*a* in the embodiments of FIGS. 2 and 3, and by virtue of the slots 30 between the six tongues or tongue members 18, it is possible, after the sabot projectile has departed from the weapon barrel, for these six tongues 18 to bend outwardly under the action of the centrifugal force which is produced by the projectile spin. This outward bending of the six tongues or tongue members 18 is accomplished to such a degree that they break off or fracture and thus no longer fixedly retain the projectile body 10 by means of their protuberances or dogs or lugs 25 or the like in the circumferential grooves 17. To further facilitate such release or detachment of the projectile body 10 there is advantageously provided at the sabot tail or rear portion 11 still a further outer circumferential groove 31. The wall thickness between both of the grooves 29 and 31 is selected to be just sufficiently thick or large that the tongues or tongue members 18 can easily break off or rupture due to the action of the centrifugal force.

Figure 4:
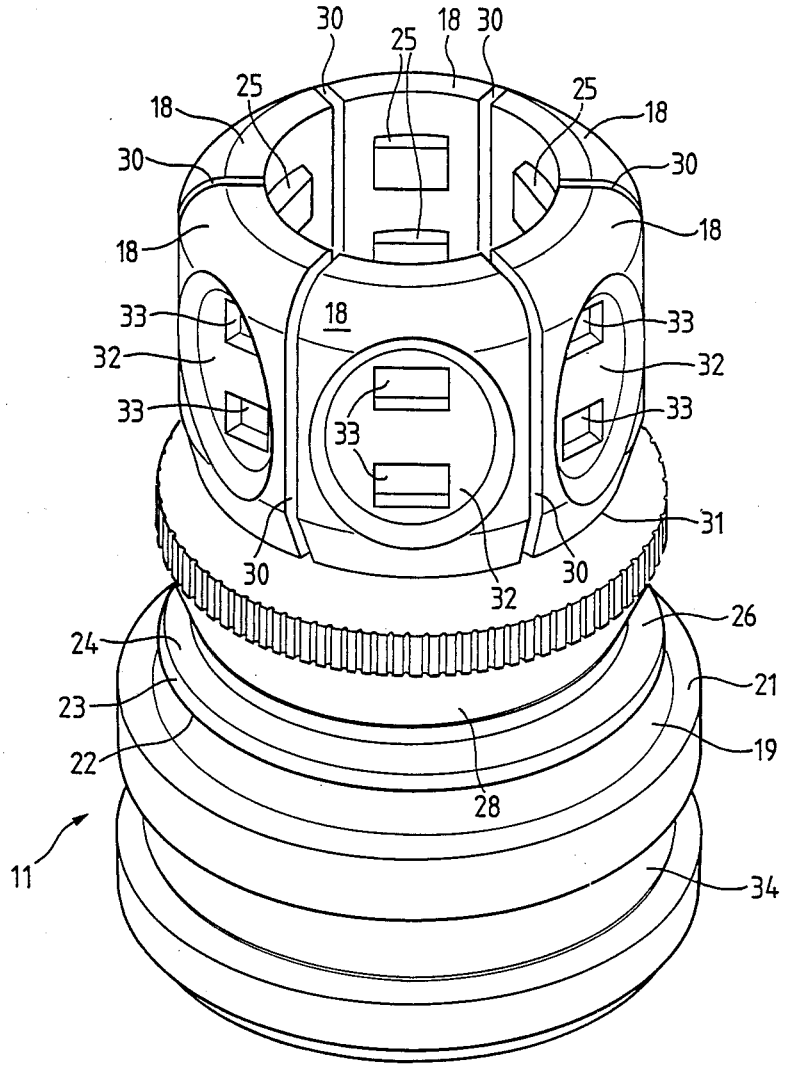
FIG. 4 is a perspective illustration of the sabot tail or rear portion of the sabot projectile depicted in FIG. 3.

In order to fabricate the protuberances or dogs or lugs 25 or equivalent structure, which first can be produced after the mounting of the projectile body 10 in the sabot tail portion 11, there is provided at each tongue or tongue member 18 a substantially disc-shaped recess or depression 32, as particularly will be seen by referring to FIG. 4. As soon as the projectile body 10 has been inserted into the sabot tail portion 11, there are pressed into the base of each of the disc-shaped recesses or depressions 32 two respective substantially rectangular recesses or depressions 33. As a result there are formed the protuberances or dogs or lugs 25 by means of which the projectile body 10 is retained in the sabot tail portion 11 since these protuberances or dogs or lugs 25 project into the related circumferential grooves 17.

Additionally, the sabot tail portion 11 possesses a further circumferential groove 34 at its rear ring or annular portion 11*b* which has a larger external diameter than the external diameter of the front ring or annular portion 11*a*. This further circumferential groove 34 serves for the attachment of a conventional, and thus not here shown, cartridge casing or sleeve.

As already stated, increasing requirements are placed upon the connection between the sabot jacket 12 and the sabot tail or rear portion 11 because of the increasing firing cadence of modern weapons systems. As also explained, the depth of the circumferential groove 34 is greater than what was heretofore the case, with the result that the greater resistance of the projectile body 10 upon extraction from the cartridge casing or sleeve, causes a greater gas pressure. With increased infeed speed or velocity of the cartridges to the firing weapon there is present an increased mechanical loading of the connection between the sabot jacket 12 and the sabot tail or rear portion 11. B appropriately constructing such connection or connection arrangement it is contemplated, according to the invention, to prevent that propellant gases will penetrate between the sabot jacket 12 and the sabot tail portion 11.

It will be observed that the invention thus is concerned with providing an improved connection or connection arrangement between the sabot jacket 12 and the sabot tail portion 11. In the exemplary embodiments depicted in FIGS. 1 to 4 such connection or connection arrangement is located rearwardly of the reference fraction location or reference fracture means, here defined, for instance, by the grooves or groove means 29 and 31.

For this purpose and to achieve the advantageous connection arrangement, the sabot tail or rear portion 11 possesses a first circumferential groove, here a circumferential sealing groove 19 and a second circumferential groove, here a circumferential holding or holder groove 26. As shown for the embodiment of FIG. 2, this circumferential sealing groove 19 can be provided with substantially mutually parallel side walls 21 and 22. These side walls 21 and 22 are here shown to be inclined forwardly at an angle of about 75° with respect to the lengthwise axis of the sabot projectile.

Figure 3:
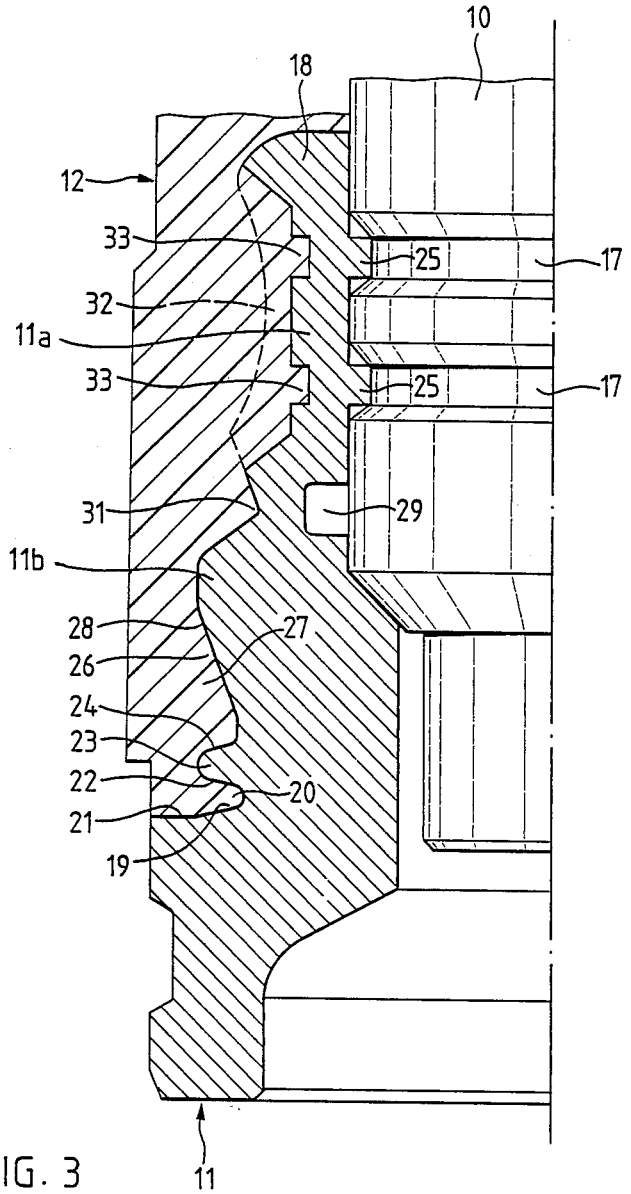
FIG. 3 is an enlarged detail showing and in fragmentary longitudinal sectional view of a second exemplary embodiment of sabot projectile constructed according to the present invention, and specifically depicting details of the sabot tail or rear portion and related sabot jacket.

However, as shown for the modified embodiment of FIGS. 3 and 4, the side walls 21 and 22 can be inclined rearwardly and forwardly with respect to the lengthwise axis of the sabot projectile, and again likewise through an angle of approximately 75°.

As shown in the arrangement of FIGS. 1 and 2, the circumferential holding or holder groove 26 can possess two side walls 24 and 28, wherein the one side wall 24 is inclined rearwardly with respect to the lengthwise axis of the sabot projectile, for instance at an angle of about 75° and the other side wall 28 is forwardly inclined with respect to the lengthwise axis of the sabot projectile, again for instance at an angle of about 75°. However, as shown in the modified embodiment of FIGS. 3 and 4, the side wall 28 can be forwardly inclined with respect to the lengthwise axis of the sabot projectile through a very small angle of, for instance, about 15°. The circumferential holding or holder groove 26 and the circumferential sealing groove 19 can be separated from one another by a rib or rib member 23, as will be noted by inspecting FIGS. 2 and 3.

By virtue of the provision of the circumferential sealing groove 19 and the circumferential holding or holder groove 26 there is respectively obtained, on the one hand, a reliable gastight connection and, on the other hand, a reliable mechanical connection or attachment which can withstand large mechanical forces.

Protruding into the circumferential sealing groove 19 is an appropriately configured sealing lip or flange or flange member 20 of the sabot jacket 12, and protruding into the second circumferential holding or holder groove 26 is an appropriately configured second holding or holder rib or flange or flange member 27 of the sabot jacket 12.

It is not absolutely necessary that the side walls 21, 22 and 24, 28 of the circumferential sealing groove 19 and the circumferential holding groove 26, respectively, be inclined as shown in FIGS. 2 and 3. They also could be, for instance, oriented essentially perpendicular to the projectile lengthwise axis. Equally, it is conceivable to use wedge-shaped or dovetail-shaped circumferentially extending grooves.

While there are shown and described present preferred embodiments of the invention, it is to be distinctly understood that the invention is not limited thereto, but may be otherwise variously embodied and practiced within the scope of the following claims. Accordingly,

What I claim is:

1. A connection arrangement between a sabot jacket and a sabot tail portion of a sabot projectile having a lengthwise axis, comprising:

a sabot tail portion having an outer surface and a rear end;

said sabot tail portion having, as viewed in a forward direction from a rear part towards a front part thereof, a first circumferential groove on said outer surface thereof;

a sabot jacket provided with a first flange member protruding into said first circumferential groove;

said sabot tail portion, as viewed in said forward direction, having a second circumferential groove on said outer surface thereof;

said sabot jacket possessing a second flange member protruding into said second circumferential groove;

said sabot tail portion being provided with groove means defining reference fracture means;

said first and second circumferential grooves being arranged behind said groove means defining said reference fracture means in a direction towards said rear end of the sabot tail portion; and said first flange member essentially serving for sealing purposes and said second flange member essentially serving for attachment purposes.

2. The connection arrangement as defined in claim 1, further including:

a circumferential rib member separating both of said first and second circumferential grooves from one another.

3. The connection arrangement as defined in claim 1, wherein:

said first and second circumferential grooves successively follow one another in said forward direction; and said second circumferential groove being located immediately adjacent said first circumferential groove.

4. The connection arrangement as defined in claim 3, further including:

a circumferential rib member separating both of said first and second circumferential grooves from one another; and said circumferential rib member possessing a relatively small width in relation to the width of the second circumferential groove.

5. The connection arrangement as defined in claim 1, wherein:

said first and second circumferential grooves each define a continuous circumferential groove.

6. The connection arrangement as defined in claim 1, wherein:

said first circumferential groove contains bounding side walls which are essentially mutually parallel to one another and are forwardly inclined with respect to the lengthwise axis of the sabot projectile.

7. The connection arrangement as defined in claim 6, wherein:

said bounding side walls of said first circumferential groove are forwardly inclined at an angle of approximately 75° with respect to the lengthwise axis of the sabot projectile.

8. The connection arrangement as defined in claim 1, wherein:

said first circumferential groove contains bounding side walls which are inclined outwardly away from each other with respect to the lengthwise axis of the sabot projectile.

9. The connection arrangement as defined in claim 1, wherein:

said second circumferential groove contains bounding side walls which are inclined outwardly away from each other with respect to the lengthwise axis of the sabot projectile.

10. The connection arrangement as defined in claim 9, wherein:

said bounding side walls of said second circumferential groove are inclined outwardly away from each other at an angle of approximately 75° with respect to the lengthwise axis of the sabot projectile.

11. A connection arrangement between a sabot jacket and a sabot tail portion of a sabot projectile having a lengthwise axis, comprising:

a sabot tail portion having an outer surface and a rear end;

said sabot tail portion having, as viewed in a forward direction from a rear part towards a front part thereof, a first circumferential groove on said outer surface thereof;

a sabot jacket provided with a first flange member protruding into said first circumferential groove;

said sabot tail portion having, as viewed in said forward direction, a second circumferential groove on said outer surface thereof;

a circumferential rib member separating both of said circumferential grooves from one another;

said sabot jacket possessing a second flange member protruding into said second circumferential groove;

said sabot tail portion being provided with groove means defining reference fracture means;

said first and second circumferential grooves being arranged behind said groove means defining said reference fracture means in a direction towards said rear end of the sabot tail portion; and said first flange member essentially serving for sealing purposes and said second flange member essentially serving for attachment purposes.

12. A connection arrangement between a sabot jacket and a sabot tail portion of a sabot projectile having a lengthwise axis, comprising:

a sabot tail portion having a front part and a rear part;

said sabot tail portion comprising at said front part a ring portion provided with tongue members;

said sabot tail portion having an outer surface and an inner surface each provided with groove means located rearwardly of said tongue members in a direction towards said rear part;

said groove means defining reference fracture means for enabling detachment of said tongue members from said ring portion;

said outer surface of said sabot tail portion having, as viewed in a forward direction from the rear part towards the front part thereof, a circumferential sealing groove on said outer surface thereof;

a sabot jacket provided with a first lip member protruding into said circumferential sealing groove;

said sabot tail portion, as viewed in said forward direction, having a circumferential holding groove on said outer surface thereof;

said circumferential sealing groove and said circumferential holding groove being formed in said outer surface of said sabot tail portion at a location rearwardly of said groove means defining said reference fracture means;

said sabot jacket possessing a second lip member protruding into said circumferential holding groove;and said first lip member essentially serving for sealing purposes and said second lip member essentially serving for attachment purposes.

* * * * *